United States Patent [19]

Debaigt

[11] 4,345,226

[45] Aug. 17, 1982

[54] ROTARY SWITCH WITH AN AUTOMATIC RE-SETTING MECHANISM

[75] Inventor: Jean Debaigt, Maisons Laffitte, France

[73] Assignee: CGEE Alsthom, Levallois-Perret, France

[21] Appl. No.: 258,162

[22] Filed: Apr. 27, 1981

[30] Foreign Application Priority Data

Apr. 25, 1980 [FR] France ..... 80 09313

[51] Int. Cl.[3] ..... H01H 9/20

[52] U.S. Cl. ..... 335/166; 335/164; 335/189

[58] Field of Search ..... 335/164, 165, 166, 169, 335/189, 190, 174, 26, 150

[56] References Cited

U.S. PATENT DOCUMENTS 4,001,740 1/1977 MacLean ..... 335/190

FOREIGN PATENT DOCUMENTS 2268346 4/1975 France .

*Primary Examiner*—Harorld Broome

*Attorney, Agent, or Firm*—Sughrue, Mion, Zinn, Macpeak & Seas

[57] ABSTRACT

A rotary switch has a control shaft (8) controlling electrical contacts (not shown). On being moved from the "OFF" position as illustrated towards an "ON" position by turning clockwise (arrow 9), a ramp (21) on a cam (2) engages a cam follower (41) mounted on a first lever arm (3). The first arm is held in position against the thrust of the cam follower's bias spring (42) by a catch (31) engaging a bearing surface (51) of a second lever arm (5). Similarly the second lever (5) is held in position by a spring (52) urging it against the moving part of an electromagnet (7). The electromagnet is shown in its powered position with spring (61) compressed thereby. Turning the shaft also winds up a return spring (not shown) tending to urge the shaft towards the "OFF" position. The shaft is held in the "ON" position by the cam follower (41) engaging in a notch (20) in the cam.

When power to the electromagnet fails (i.e. normally the power that is switched by the switch), its moving part is thrust by the spring (61) in the direction of arrow 91. This disengages the catch (31) from the bearing surface (51), allowing the first lever to move away from the shaft, and hence disengaging the cam follower from the notch (20). The shaft is then free to return to its "OFF" position under the action of its return spring.

5 Claims, 1 Drawing Figure

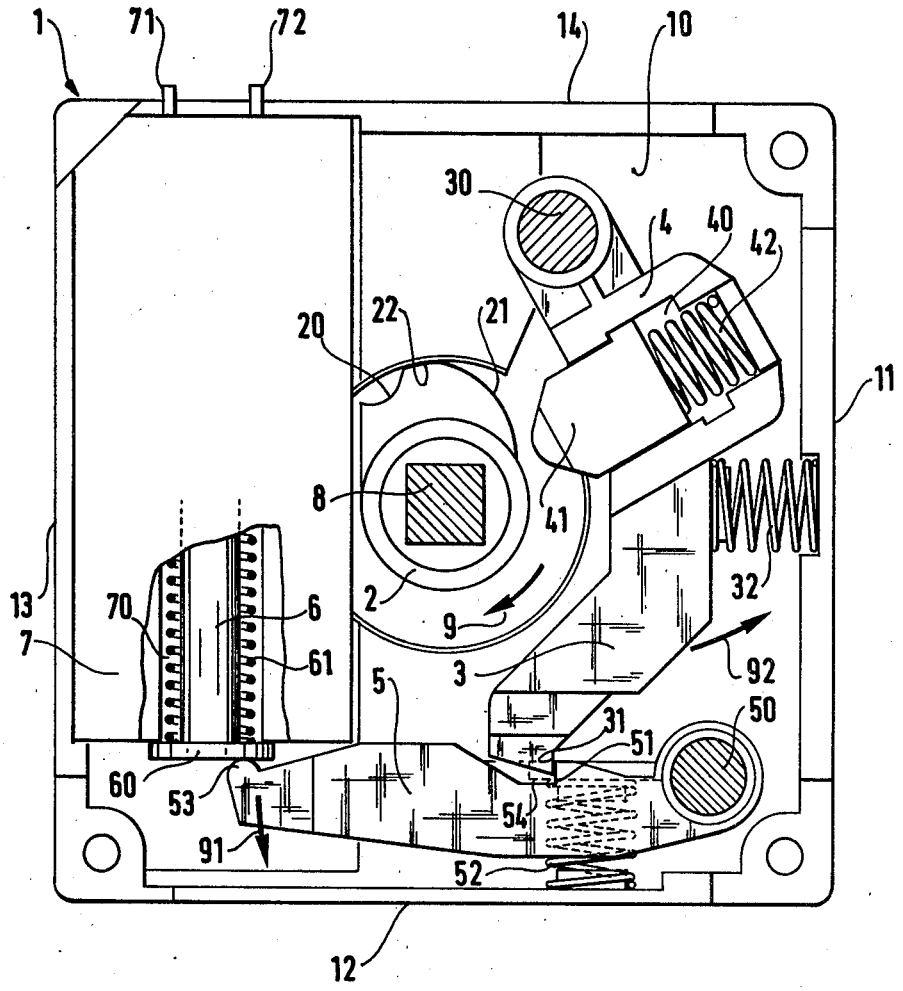
1
71
72
14
10
30
4
40
42
20
22
21
11
8
41
13
70
6
2
9
32
7
61
3
92
5
31
50
51
60
53
54
91
52
12

ROTARY SWITCH WITH AN AUTOMATIC RE-SETTING MECHANISM

The present invention relates to automatically resetting a rotary electrical switch in the event that the power switched by the switch should fail.

BACKGROUND TO THE INVENTION

Rotary switches generally comprise a control shaft having a plurality of stable fixed positions. However, to control some types of apparatus, it is necessary that the switch should return to its "OFF" position in the event of a power failure.

Various re-setting mechanisms for performing this function are known. However, most include over-center locking assemblies that need a large number of component parts, such as articulated linkages. This leads to bulky mechanisms that are expensive to manufacture.

Preferred embodiments of the present invention provide compact switches with simplified re-setting mechanisms that take up less room and are cheaper than previously.

SUMMARY OF THE INVENTION

The present invention provides a rotary switch for switching electrical power, said switch including a resiliently biased holding electromagnet capable of being powered by the same power supply as that which is switched by the switch, a switch-operating control shaft provided with a return spring resiliently urging said shaft towards an "OFF" position, and an automatic re-setting mechanism responsive to loss of power to the electromagnet to cause the switch to return to said "OFF" position, wherein the re-setting mechanism comprises:

a positioning cam fast with said control shaft and including at least one positioning notch;

a first lever rotatable about a first fixed point and having a locking catch distant from said first fixed point, said first lever further having a resiliently biased cam follower directed towards said control shaft and engaging said notch in said positioning cam in such a manner as to retain the shaft in an "ON" position against the resilient bias of said return spring; and a second lever rotatable about a second fixed point and having a nose distant from said second fixed point resiliently biased against a moving head of the electro-magnet, said second lever further having a bearing surface for receiving the locking catch of said first lever to hold said first lever against the resilient thrust of its cam follower;

the relative positions of the electromagnet, the first and second levers, and the shaft being such that so long as power is supplied to said electromagnet, the power holds the electromagnet against its own resilient bias, said second lever holds said first lever against the resilient bias of the cam follower, and said cam follower engages in said positioning notch to hold said shaft against the bias of the return spring, but that on failure of power to the electromagnet, the nose of the second lever is thrust by the resilient bias of the electromagnet in such a direction as to cause the bearing surface to disengage from the catch, thereby releasing the first lever to rotate away from the shaft under the thrust of the cam follower, and hence disengaging the cam follower from the positioning notch and thus allowing the return spring to return the shaft to the "OFF" position.

BRIEF DESCRIPTION OF THE DRAWING

An embodiment of the present invention is described, by way of example, with reference to the sole FIGURE of the accompanying drawing, which is a diagrammatic section through a rotary switch in the "OFF" position.

DESCRIPTION OF PREFERRED EMBODIMENT

The FIGURE shows a rotary switch in the "OFF" position, but with electrical power present. The switch is housed in a rectangular casing 1, having a base 10 and four side walls 11, 12, 13 & 14. A control shaft 8 passes perpendicularly through the middle of the base, and is equipped with a return spring (not shown).

The control shaft 8 is of square section, and a positioning cam 2 with a square bore is threaded over the shaft. The cam 2 has an engagement ramp 21 followed by a portion of circular profile arranged concentrically about the axis of the shaft 8, and ends in a positioning notch 20.

A first lever 3 is hinged about a first fixed point 30 fast with the base 10, and extends generally along the side 11 of the casing. The lever 3 carries a cam follower 4 comprising a housing 40 with a slidable plunger 41 mounted therein and urged towards the shaft 8 by a compression spring 42. The end of the lever 3 has a catch 31. A spring 32 acts between the side wall 11 and the lever 3, and serves, in the absence of any other force, to urge the level 3 to its normal position.

A second lever 5 is hinged about a second fixed point 50, likewise fast with the base 10, and extends generally along the side wall 12 which is adjacent to the side wall 11. The lever 5 includes a notch directed towards the catch 31 and including a bearing surface for engaging the catch when the first lever 3 is in its normal position. The free end of the second lever 5 includes a nose 53 in contact with a circular head 60 at one end of the moving core 6 of an electromagnet 7. A spring 52 acts between the side wall 12 and a spring-receiving boss 54 of the lever 5, to urge the nose 53 against the head 60.

The electromagnet 7 extends along the side wall 13 which is adjacent to the side wall 12. The electromagnet has two terminals 71 and 72 to enable it to be powered from the same power supply as the apparatus controlled by the switch.

The moving core 6 is disposed in an axial bore 70 through the electromagnet 7. A compression spring 61 acts between the end of the bore 70 and the head 60 of the moving core 6.

The switch operates as follows. While the winding of the electromagnet is powered, it attracts the moving core 6 so that its head 60 bears against the end of the winding. Under the effect of the spring 52, the second lever 5 has its nose 53 pressing against the head 60 of the core 6, thereby enabling it to receive the catch of the first lever 3 in the notch near the bearing surface 51, with the spring 32 sufficing to hold the first lever 3 in this normal position. This is the position shown in the FIGURE.

To turn the switch "ON", the shaft 8 must be rotated through a quarter turn clockwise as shown by an arrow 9, against the bias of its return spring. During this operation, the end of the plunger 41 comes into contact with the ramp 21 of the cam 2, and slides over the ramp 21 and then the circular profile 22 thereby compressing the spring 42. Then the plunger 41 engages the positioning notch 20 under the thrust of the spring 42 and locks the shaft 8 in the "ON" position. Meanwhile the first lever 3 is prevented from moving under the action of the spring 42 by the catch 31 pressing against the bearing surface 51 of the second lever 5.

When the power fails, the moving core 6 is thrust outwardly from the electromagnet 7 by the spring 61. This pushes the nose of the second lever 5 in the direction shown by the arrow 91, thereby pivoting the second lever 5 and releasing the catch 31 of the first lever 3 from the bearing surface 51. Then, under the action of the spring 42 in the cam follower 4 the first lever is rotated in the direction of arrow 92, thereby releasing the end of the plunger 41 from the notch 20, and hence allowing the return spring to return the control shaft 8 to its "OFF" position, by rotating it through a quarter turn anti-clockwise. The first lever 3 is then returned to its normal position by the spring 32, since the cam follower is no longer engaged with the cam 2.

When power re-appears at the terminals of the electromagnet 7, the head 60 of the moving core 6 is brought back against the winding of the electromagnet and the spring 52 ensures that the nose 53 of the second lever 5 remains in contact with the head 60, thereby making it possible to turn the switch "ON" again.

I claim:

1. A rotary switch for switching electrical power, said switch including a resiliently biased holding electromagnet capable of being powered by the same power supply as that which is switched by the switch, a switch-operating control shaft provided with a return spring resiliently urging said shaft in rotation towards an "OFF" position, and an automatic re-setting mechanism responsive to loss of power to the electromagnet to cause the switch to return to said "OFF" position, wherein the re-setting mechanism comprises:

a positioning cam fixed with said control shaft and including at least one positioning notch;

a first lever rotatable about a first fixed point and having a locking catch spaced from said first fixed point, said first lever further having a resiliently biased cam follower directed towards said control shaft for engaging said notch in said positioning cam in such a manner as to retain the shaft in an "ON" position against the resilient bias of said return spring; and a second lever rotatable about a second fixed point and having a nose spaced from said second fixed point resiliently biased against a moving head of the electromagnet, said second lever further having a bearing surface for receiving the locking catch of said first lever to hold said first lever against the resilient thrust of its cam follower;

the relative positions of the electromagnet, the first and second levers, and the shaft being such that so long as power is supplied to said electromagnet, the power holds the electromagnet against its own resilient bias, said second lever holds said first lever against the resilient bias of the cam follower, and said cam follower engages in said positioning notch to hold said shaft against the bias of the return spring, but that, on failure of power to the electromagnet, the nose of the second lever is thrust by the resilient bias of the electromagnet in such a direction as to cause the bearing surface to disengage from the catch, thereby releasing the first lever to allow it to rotate away from the shaft under the thrust of the cam follower, and hence disengaging the cam follower from the positioning notch and thus allowing the return spring to return the shaft to the "OFF" position.

2. A switch with an automatic re-setting mechanism according to claim 1, wherein the switch is housed in a rectangular casing, and wherein the nose of said second lever is biased against the head of the electromagnet by a compression spring situated between a side wall of the casing and a spring-receiving boss on said second lever.

3. A switch with an automatic re-setting mechanism according to claim 1, wherein a housing is mounted on the first lever and said cam follower comprises a resiliently biased plunger slidably mounted therein for movement substantially tangentially about the first fixed point, the plunger having a free end for engaging the cam.

4. A switch with an automatic re-setting mechanism according to claim 1, wherein the first lever is provided with a return spring disposed to return the first lever to its normal operating position once the shaft has returned to its "OFF" position with the cam rotated to a position in which it does not engage the cam follower sufficiently to thrust the first lever away from its normal position.

5. A switch with an automatic re-setting mechanism according to claim 4, wherein the positioning notch of the cam is preceded by an engagement ramp for contact with the cam follower to cause the catch on the first lever to engage and lock against the bearing surface of the second lever as the control shaft is rotated from its "OFF" position towards said "ON" position.

* * * * *